US009428308B2

(12) United States Patent
Bet

(10) Patent No.: US 9,428,308 B2
(45) Date of Patent: Aug. 30, 2016

(54) STOPPER HAVING A SLIDING PLUG AND COMPRISING MULTIPLE DISTRIBUTION HOLES

(75) Inventor: Robert Bet, Velars sur Ouche (FR)

(73) Assignee: BERICAP, Longvic (FR)

( * ) Notice: Subject to any disclaimer, the term of this patent is extended or adjusted under 35 U.S.C. 154(b) by 126 days.

(21) Appl. No.: 14/009,136

(22) PCT Filed: Apr. 5, 2012

(86) PCT No.: PCT/EP2012/056245

§ 371 (c)(1),
(2), (4) Date: Mar. 26, 2014

(87) PCT Pub. No.: WO2012/136746

PCT Pub. Date: Oct. 11, 2012

(65) Prior Publication Data

US 2014/0197126 A1 Jul. 17, 2014

(30) Foreign Application Priority Data

Apr. 5, 2011 (FR) ..... 11 01020

(51) Int. Cl.
*A47G 19/22* (2006.01)
*B65D 39/00* (2006.01)
*B65D 47/24* (2006.01)

(52) U.S. Cl.
CPC ..... *B65D 39/0052* (2013.01); *B65D 47/243* (2013.01); *A47G 19/2272* (2013.01); *B65D 47/247* (2013.01)

(58) Field of Classification Search
CPC ..... B65D 39/0052; B65D 47/243; B65D 47/245; B65D 47/247; A47G 19/2272
USPC ..... 215/364, 311; 222/525, 559; 220/254.9
See application file for complete search history.

(56) References Cited

U.S. PATENT DOCUMENTS 3,439,842 A * 4/1969 Stull ..... 222/196.3
3,834,596 A * 9/1974 Brady ..... B65D 47/242 222/520
4,826,055 A * 5/1989 Stull ..... 222/524
5,104,008 A * 4/1992 Crisci ..... 222/153.07

(Continued)

FOREIGN PATENT DOCUMENTS

GB 1168642 A 10/1969
WO WO-2010046566 A1 4/2010
WO WO-2010046568 A1 4/2010

*Primary Examiner* — James N Smalley
(74) *Attorney, Agent, or Firm* — Harness, Dickey & Pierce, P.L.C.

(57) ABSTRACT

A stoppering device to be secured to a container neck includes a tubular spout defining a passage opening, and a plug. The plug has an outer tubular shell sliding on the tubular spout, and a bottom provided with a sealing skirt and multiple distribution holes. The bottom of the plug engages with the connecting wall of the tubular spout in the plugging position, while preserving an annular retention space between the bottom of the plug and the tubular spout. The bottom includes radial ribs which are in an alternating arrangement between the distribution holes, and constitute retention facets retaining the liquid held in the retention space by adhesion. The small volume of liquid which, during the plugging phase, would be prevented from flowing back into the container closed by the stoppering device, can remain in the annular retention space without any particular risk of abrupt ejection, the retention being promoted by the presence of multiple walls in the chamber, in particular the retention facets.

19 Claims, 2 Drawing Sheets

(56) References Cited

U.S. PATENT DOCUMENTS

| | | | | |
|---|---|---|---|---|
| 5,472,120 | A * | 12/1995 | Stebick et al. | 222/153.06 |
| 5,975,369 | A * | 11/1999 | Yurkewicz et al. | 222/153.06 |
| 6,073,809 | A * | 6/2000 | Long, Jr. | 222/153.06 |
| 6,095,375 | A * | 8/2000 | Adams et al. | 222/182 |
| 6,257,463 | B1 * | 7/2001 | De Polo | 222/525 |
| 6,325,226 | B1 | 12/2001 | Krautkramer | |
| 6,450,357 | B1 | 9/2002 | Krautkramer et al. | |
| D480,305 | S | 10/2003 | Nusbaum et al. | |
| 6,874,656 | B2 * | 4/2005 | Rohr et al. | 222/1 |
| 6,874,664 | B1 * | 4/2005 | Montgomery | 222/525 |
| 7,036,683 | B2 | 5/2006 | Dubach | |
| 7,077,278 | B2 | 7/2006 | Dubach | |
| 7,077,294 | B2 | 7/2006 | Nusbaum et al. | |
| D556,575 | S | 12/2007 | Nusbaum et al. | |
| RE40,003 | E | 1/2008 | Bennett et al. | |
| 7,611,025 | B2 | 11/2009 | Nusbaum et al. | |
| D623,517 | S | 9/2010 | Pechinot | |
| 8,231,018 | B2 | 7/2012 | Gassner | |
| 2008/0023502 | A1 * | 1/2008 | Knes | 222/524 |

* cited by examiner

STOPPER HAVING A SLIDING PLUG AND COMPRISING MULTIPLE DISTRIBUTION HOLES

CROSS-REFERENCE TO RELATED APPLICATIONS

This application is a National Phase Entry of International Application No. PCT/EP2012/056245, filed on Apr. 5, 2012, which claims priority to French Patent Application Serial No. 1101020, filed on Apr. 5, 2011, both of which are incorporated by reference herein.

TECHNICAL FIELD

The present invention relates to a stopper consisting of at least two parts, including a sliding plug translatable relative to a base between a plugging position and an open position, in which the plug remains secured to the base and forms a spout with several orifices.

BACKGROUND

Stoppers that perform plugging through a sliding movement without separation of a plug relative to a tubular base have found favor with consumers for some time now, in particular to meet traveling needs when no glass is available to drink, the plug being configured to be able to be taken in the mouth with proven ergonomics guaranteeing great simplicity of use. Among these stoppers, some have multiple distribution holes at the plug taken into the mouth, to allow a flow of several jets, like a shower. This particular arrangement allows a greater mixture of liquid and air than a flow through a single hole, and thereby provides increased consumption comfort for certain beverages, which amounts to a feeling of freshness and pleasing flavors.

Stoppers of this type, however, have an increased risk of splashing upon plugging. In fact, to plug the stopper device, the consumer presses on the plug, which slides until it reaches its plugging position. On its trajectory, the plug passes through a transitional intermediate position docked alongside the base, from which position a sealed sliding contact is established between the plug and the base as far as the final plugging position. If, when that docked position is reached, liquid is still in the portion of the plug situated above that sealed contact, that liquid trapped between the seal and the spout is, in the continuation of the plugging travel, pushed back toward the distribution holes through a relative movement of the parts, the tubular spout of the base acting as a sort of piston sliding inside the plug. The distribution holes at that time form an equal number of acceleration nozzles for the liquid, which is ejected toward the outside. This risk, which is very detrimental for consumers, who may become stained with the ejected liquid, was identified in document WO201046566, which proposes to give the distribution holes an outwardly flared shape. This solution proves effective when the thickness of the wall of the plug passed through by the holes, which defines the length of those holes, is sufficient. A need nevertheless remains in certain configurations, in particular when the beverage contained in the container has a high surface tension and tends not to flow back quickly toward the container in the phase immediately preceding plugging.

In document U.S. Pat. No. 3,439,842, a two-part stopper of the preceding type is also described, made up of a base including a planar wall from which a tubular spout protrudes forming a passage orifice for the liquid, and a plug envelooping the tubular spout. This plug includes an outer tubular shell and a bottom from which protrudes, toward the base, a sealing skirt inserted, in a plugging position, in the tubular spout. The bottom of the plug further has multiple distribution holes with a small section. The tubular spout of the base is provided with spurs surrounding the passage orifice and designed, in the plugging position, to be placed in the distribution holes. The plugging of the plug may be hindered by the presence of the spurs, if the latter are not situated correctly across from the distribution holes. The consumer risks pressing firmly on the plug to obtain plugging thereof while rotating the plug to seek the alignment of the spurs and distribution holes. At the time when that alignment is obtained, the plugging is done even more quickly if the consumer presses firmly on the plug. At the end of plugging, the lower portion of the outer tubular shell of the plug abuts abruptly over its entire circumference against a planar wall of the base. An unprepared consumer, in particular a child, then risks pinching his fingers (or even lips) between the plug and the base. Furthermore, these plugging kinematics lend themselves to liquid ejections through the distribution holes. This ejection risk is still further increased by the shape of the distribution holes, which have a section that narrows in the direction of the flow, favoring an acceleration of the liquid by Venturi effect. The aforementioned plugging difficulties have a corollary during assembly, and lead to a high defect and discard rate if no precautions are taken to present the parts at a predetermined angle before they are engaged. Aside from the assembly faults recognized due to the lack of alignment between the plug and the base, there is also a risk of the contact surface between the plug and the base, which becomes visible upon opening, being marked by the contact. The design of the stopper is also not completely satisfactory in terms of the chains of dimensions, the surfaces of the plug and the base that abut to define the plugging position being relatively far from those defining the sealing.

In document DE 10 2004 055 338, a stopper is described including a tubular spout to be fastened to the neck of the container, the spout being provided with a central well with which a plug translatable relative to the spout cooperates to plug or free the passage formed by the central well. The plug is provided with flow holes distributed on its periphery so as to allow, in the open position, the passage of the liquid from the inside of the container through the well and the flow holes toward the outside. The spout is provided, on its periphery, with tabs protruding radially and axially. These tabs constitute end-of-travel stops for the plugs in the plugging position, an annular retention volume being preserved in a position between the plug and the spout. This volume is intended to prevent an ejection of liquid upon closing. However, it has been observed that if the liquid trapped in the retention volume does not escape violently during plugging, that liquid nevertheless risks escaping sooner or later after plugging through the flow holes provided in the plug.

SUMMARY

The invention aims to resolve all or some of the drawbacks of the state of the art identified above. To that end, according to a first aspect of the invention, proposed is a stopper device to be secured to a container neck intended for a liquid, the stopper device including:

a tubular spout defining a reference axis of the device and delimiting a passage opening; and a plug that can be translated relative to the tubular spout parallel to the reference axis between a plugging position and a distribution position, the plug having an outer tubular shell enveloping the tubular spout and sliding on the tubular spout; and a bottom extending perpendicular to the reference axis, the bottom being provided with a sealing skirt, and several distribution holes, the sealing skirt cooperating with the tubular spout in the plugging position to plug the passage opening, and freeing the passage opening to form several passageways from the container toward the outside through the passage opening and the distribution holes when the plug goes from the plugging position to the distribution position, the bottom of the plug bearing axially against the tubular spout in the plugging position while preserving an annular retention volume between the bottom of the plug and the tubular spout, the annular volume communicating with the outside by the distribution holes, the bottom having radial ribs positioned one between each two of the distribution holes and forming retention facets by adherence of the liquid imprisoned in the retention volume.

As the plugging end-of-travel stop is made in a space not accessible to consumers, any risk of pinching at the stop is eliminated. As this confined space is also not visible at the opening, in the distribution position, no region marked by the contact between parts is exposed. The small volume of liquid found, during the plugging phase is prevented from flowing back into the container plugged by the plugging device, and can remain in the annular retention volume without any particular risk of abrupt ejection. Even though the distribution holes constitute passageways through which the liquid can flow, that flow, if it occurs despite the surface tension and induced adherence, will be done with no speed.

The radial ribs increase the surfaces on which the liquid can fix itself in the annular retention volume, which is particularly suitable for a sugary beverage or a beverage containing surface agents increasing the adhesion to the surfaces. According to one embodiment, the tubular spout includes an outer tubular guide wall on which the plug slides between the plugging and distribution positions, an inner tubular passage wall delimiting the passage orifice and which the sealing skirt penetrates to plug the passage orifice by annular contact with the inner passage wall, and an annular connecting wall extending radially from the tubular outer guide wall to the tubular inner passage wall, the ribs forming a stop abutting axially against the annular connecting wall. Preferably, the ribs have an axial dimension that is small near the reference axis and increases moving radially away from the reference axis.

For satisfactory guiding of the plug relative to the spout over the entire course between the distribution and plugging positions, it is possible to provide that the outer tubular shell of the plug has at least one annular guide shank protruding radially toward the spout and in sliding contact with a cylindrical guide surface of the tubular spout between the plugging and distribution positions. It is also possible to provide that the tubular spout has at least one annular guide shank protruding radially toward the outer tubular shell of the plug and in sliding contact with a cylindrical guide surface of the outer tubular shell of the plug between the plugging and distribution positions. According to one preferred embodiment, the tubular spout has two annular guide shanks situated axially on either side of the annular edge of the outer tubular shell of the plug.

To avoid end-of-travel impacts upon plugging and further decrease the risks of splashing, it is possible to provide that the device does not include means for snapping in the plugging position. To minimize the acceleration of the plug at the beginning of the plugging travel, and thus still further limit the risks of splashes, it is possible to provide that the device does not include means for snapping in the distribution position.

According to one embodiment, the distribution holes each have a smaller section, the sum of the smallest sections of the distribution holes being substantially equal, to within 20%, to a smaller passage section defined between the sealing skirt of the plug and the tubular spout in the distribution position. A compromise is thus found between a maximum flow rate for consumption and the search for a small volume of liquid captured during the planning phase. To still further limit the captured volume of liquid, the sum of the smallest sections of the distribution holes will be made smaller than the smallest passage section defined between the sealing skirt of the plug and the tubular spout in the distribution position.

Preferably, the plug is free to rotate relative to the spout about the reference axis both in the plugging position and the distribution position and in any intermediate position. There is therefore no angular indexing of the plug relative to the spout, which considerably simplifies assembly. Preferably, the tubular spout is an integral part of the base having raised portions for fastening to the container neck. Preferably, the outer tubular shell includes an end-of-travel distribution stop cooperating with the tubular spout to prevent the plug from separating from the tubular spout. Any risk of the plug being absorbed by the consumer is thus avoided. According to one preferred embodiment, the plug includes several distribution holes distributed on the periphery of the skirt.

According to another aspect of the invention, the invention relates to a plugging device to be secured to a container neck intended to contain a liquid, the plugging device including:

a tubular spout defining a reference axis of the device, the spout including an outer tubular guide wall, an inner tubular passage wall delimiting a passage orifice, and an annular connecting wall between the outer tubular guide wall and the inner tubular passage wall; and a plug sliding in translation on the outer tubular guide wall parallel to the reference axis between a plugging position and a distribution position, the plug having a tubular outer shell enveloping the tubular spout and sliding on the tubular spout; and a bottom extending perpendicular to the reference axis, the bottom being provided with a sealing skirt and several distribution holes distributed on the periphery of the skirt, the sealing skirt penetrating the inner tubular passage while in the plugging position to plug the passage orifice through annular contact with the inner passage wall, and freeing the passage orifice to form several passageways from the container toward the outside through the passage orifice and the distribution holes when the plug goes from the plugging position to the distribution position, the bottom of the plug having radial ribs positioned one between each two of the distribution holes while forming an axial stop bearing axially against the connecting wall of the tubular spout in the plugging position while preserving an annular retention volume between the bottom of the plug and the tubular spout, the retention volume communicating with the outside by the distribution hole(s), the ribs forming retention walls by adhesion of the liquid captured in the retention volume.

BRIEF DESCRIPTION OF THE DRAWINGS

Other features and advantages of the invention will emerge from reading the following description, in reference to the appended figures, which illustrate.

For greater clarity, the identical or similar elements are identified using identical reference signs in all of the figures.

DETAILED DESCRIPTION

The stopper device shown in the figures is made up of two parts, i.e., a base 10 to be fastened on the neck of a container (not shown) and a plug 12. Optionally, a cover may be provided protecting against dust, which covers at least the plug 12. This optional cover is not shown here, as it is not useful to understand the invention.

Figure 1:
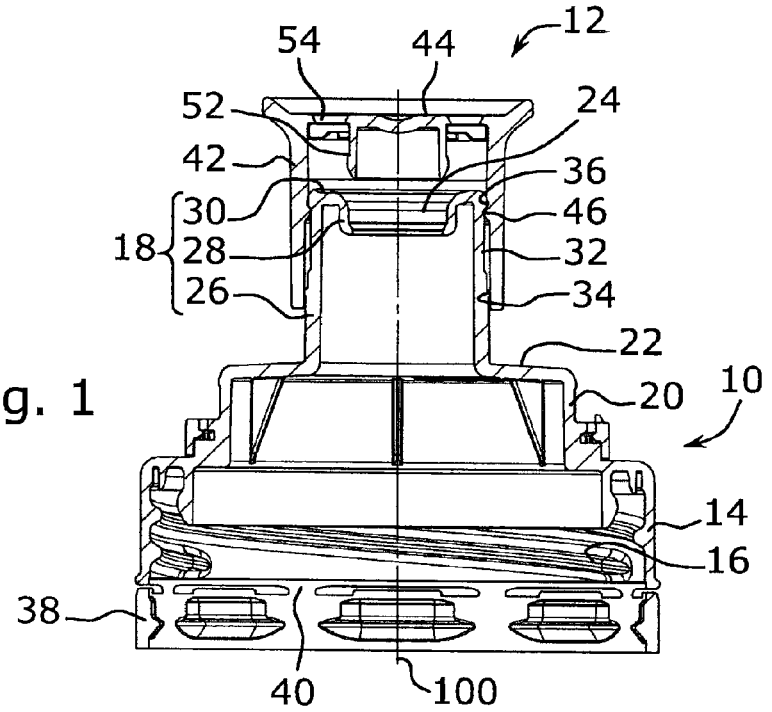
FIG. 1, a cross-sectional view of a stopper device according to one embodiment of the invention, in a distribution position.
Figure 2:
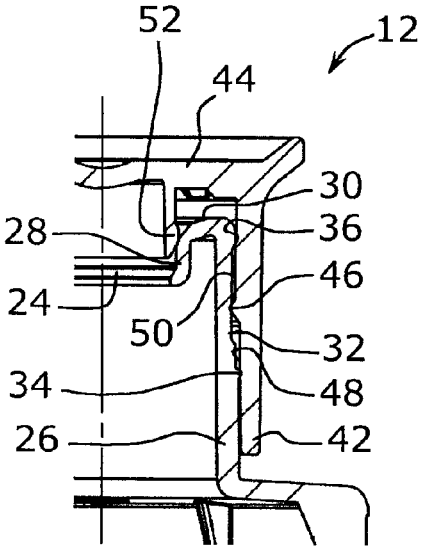
FIG. 2, a cross-sectional view of the stopper device of claim 1, in an intermediate docked position.
Figure 3:
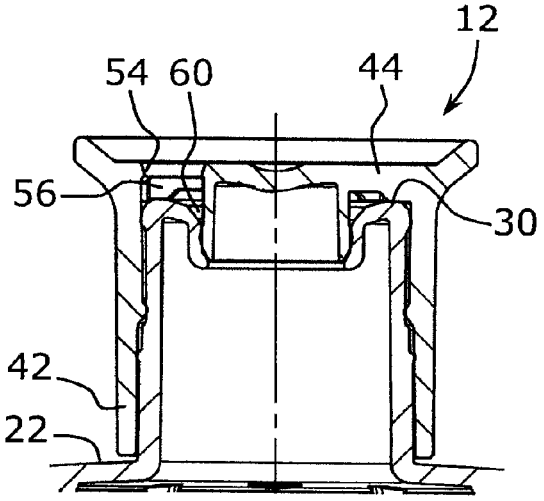
FIG. 3, a cross-sectional view of the stopper device of claim 1, in a plugging position.
Figure 4:
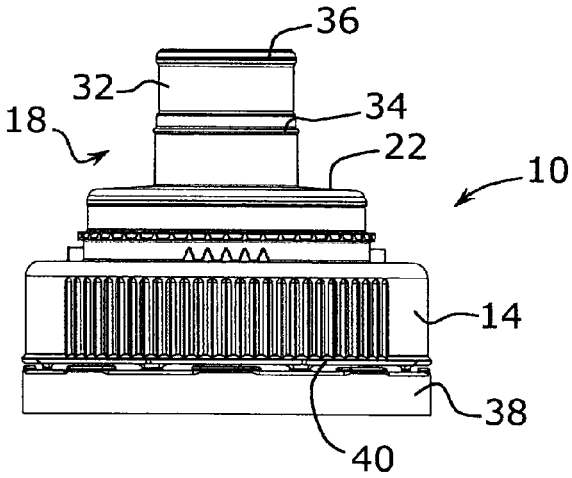
FIG. 4, a side view of a base of the stopper device of FIG. 1.

The base 10, shown in side view in FIG. 4 and cross section in FIGS. 1 to 3, is made up of a cylindrical fastening wall 14 having an inner thread 16 for fastening to the container neck, the tubular spout 18 and a connecting wall 20 between the tubular spout and the cylindrical fastening wall, said connecting wall here being stepped and in particular having a planar annular portion 22 allowing a reduction in diameter between the cylindrical fastening wall 14 and the tubular spout 18. The tubular spout 18 protrudes from said planar annular portion 22 toward the plug 12 and finds a geometric reference axis 100 of the stopper device. The tubular spout 12 forms a passage orifice 24 for a liquid, in practice a beverage, from the inside of the container toward the outside. The tubular spout 18 includes a tubular outer guide wall 26, a tubular inner passage wall 28 delimiting the passage orifice 24, and an annular connecting wall 30 making up a rim of the passage orifice 24 and extending radially from the outer tubular guide wall 26 to the inner tubular passage wall 28. The outer guide wall 26 has a guide section 32, here cylindrical, but which may possibly be slightly tapered or profiled depending on the case, extending between a lower shank 34 close to the planar annular portion 22 and an upper shank 36 further from the planar annular portion 22. The base may also include a frangible tamper-proof ring 38 connected to the cylindrical fastening wall 14 by frangible bridges 40.

Figure 5:
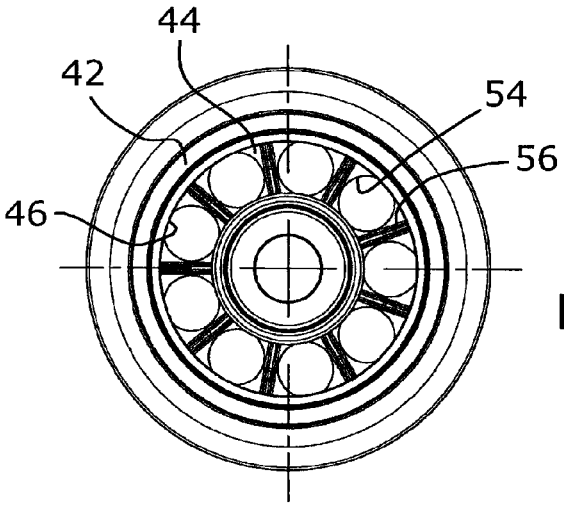
FIG. 5, a bottom view of a plug of the stopper device of FIG. 1.
Figure 6:
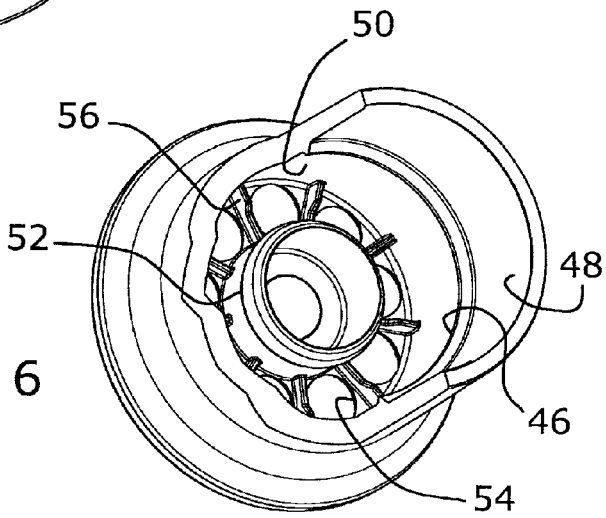
FIG. 6, a perspective view making it possible to see the inside of the plug of FIG. 5.

The plug 12, shown in detail in FIGS. 5 and 6, covers the tubular spout 18 and has an outer tubular shell 42 enveloping the tubular spout 18 and a bottom 44 extending perpendicular to the reference axis. As shown in particular in FIG. 6, the inner face of the outer tubular shell 42 is provided with an annular guide bead 46 protruding toward the tubular spout 18 and coming into contact with the guide section 32 of the spout. Furthermore, the tubular outer shell 42 has, on its inner face, two guide faces 48, 50 axially on either side of the bead 46. These walls, here cylindrical, are each in contact with one of the guide shanks 34, 36 of the spout 18. The plug 12 is thus translatable parallel to the reference axis 100 and guided in that movement by the two shanks 34, 36 and the bead 46 sliding on the corresponding guide faces 48, 50, 32 between an extreme distribution position shown in FIG. 1, in which the bead 46 abuts axially against the upper shank 36, and an extreme plugging position shown in FIG. 3, passing through an intermediate position shown in FIG. 2. The bead 46 and the upper shank 36 are configured such that it is not possible to separate the plug 12 from the spout 18 without exerting a considerable force, much greater than that which a consumer may exert under normal usage conditions. The guide faces 48, 50, 32 are all surfaces of revolution about the geometric reference axis 100, such that from the plugging position to the distribution position, the plug is free to rotate relative to the spout about the reference axis.

The bottom 44 of the plug is provided with a sealing skirt 52 protruding toward the spout 18. This sealing skirt 52 has a general shape of revolution about the reference axis 100, and preferably cylindrical or slightly tapered flared toward the spout, to penetrate the passage orifice 24 and plug the latter when the plug goes from the distribution position of FIG. 1 to the plugging position of FIG. 3. The bottom 44 of the plug also has several distribution holes 54 distributed at the periphery of the sealing skirt, the portion of the bottom covering the sealing skirt being solid. The distribution holes 54 may be cylindrical, or preferably have an outwardly flared shape, opposite the spout 18.

The bottom 44 of the plug also has radial ribs 56 protruding from the bottom and positioned between the distribution holes 54. These ribs 56 have a small axial dimension near the geometric reference axis 100, and increasing moving away from the geometric reference axis 100. The bottom 44 also has, in the space not occupied by the ribs 56 and outside the distribution holes 54, a planar surface turned toward the spout 18 and perpendicular to the ribs 56.

The plugging device operates as follows. In the distribution position of FIG. 1, the beverage may flow freely from the inside of the container toward the outside through the passage orifice 24 and the distribution holes 54, forming multiple jets. Depending on the desired effect, the smallest section of the distribution holes 54 must be adapted to the cross section of the passage delimited between the plug 18 and the sealing skirt 52. The "cross section" here refers to the product of the smallest distance between the sealing skirt and the plug in the distribution position multiplied by the corresponding parameter measured midway between the sealing skirt and the plug. In an application where one does not wish for the flow through the distribution holes to take place at a high speed, the sum of the small sections of the distribution holes will be made to be greater than the cross section of the passage. If, on the contrary, powerful jets are desired, a greater cross section of the passage between the plug and the sealing skirt, therefore a greater axial distance between the sealing skirt 52 and the spout 18 in the distribution position, will be provided for the distribution holes 54 with a given section. By choosing equal sections, or equal to within 10% or 20%, balancing of the passage between the plug and the spout will be obtained, the pressure exerted on the container in that case conditioning the ejection speed.

To plug the stopper device, the consumer presses on the plug 12, which begins to slide until it reaches the plugging position of FIG. 3, passing through the intermediate position of FIG. 2. This intermediate position here bears mentioning, as it makes it possible to explain the problem that may be encountered by consumers and is resolved by the invention.

As a general rule, the container is oriented with its neck upward at the time of plugging, such that the beverage does not flow toward the outside and should, on the contrary, flow back toward the container. The connecting wall 30 and the inner passage wall 28 are also configured as a funnel to favor this return for the container. Liquid may, however, remain captured between the plug 12 and the spout 18, in particular if the interfacial tension between the liquid and the walls of the plugging device favors adhesion on the latter. The small quantity of liquid that has not flowed back is caught once the device, during the plugging phase, reaches the docked position of FIG. 2, which corresponds to the first contact between the sealing skirt 52 and the spout 18 and the plugging of the return passage toward the bottle, creating the captive liquid volume.

The position of FIG. 2 is only a transitional position, and the plug continues its path until the plug 12 abuts against the spout 18 in the extreme position of FIG. 3. In this case, it is the bottom 44 of the plug 12 that abuts axially against the spout 18, without there being any contact between the outer tubular shell 42 of the plug and the transverse wall 22 of the base. It is thus possible to freely dimension the space one wishes to preserve in the plugging position between the outer tubular shell 42 and the transverse wall 22 of the base. More specifically, in this embodiment, the contact is produced between the ribs 56 of the bottom and the connecting wall 30 of the spout, in the portion of the ribs 56 having the largest axial dimension and situated radially outside.

In the position of FIG. 3, the ribs 56 do not completely isolate the distribution holes 54 from each other. On the contrary, an annular retention volume 60 connecting the distribution holes 54 to each other is preserved. This retention volume 60 is greater than the volume of liquid that one may reasonably expect to find trapped between the spout 18 and the plug 12 at the time of plugging, under normal plugging conditions, i.e., with the vertical geometric reference axis or forming an angle of less than 45° with the vertical, the plugging device being above the neck of the container. There is therefore no piston effect between the spout 18 and the plug 12, and therefore no risk of untimely ejection of liquid through distribution holes 54.

The ribs 56 constitute facets on which the liquid may adhere, such that the small volume of liquid caught in the retention volume does not risk escaping through the distribution holes 54. It should be noted that in order to limit the initial acceleration of the plug 12 at the beginning of the plugging travel, i.e., the moment when the position of FIG. 1 is left, it is possible to provide that this position is not axially indexed. In other words, it is possible to choose not to provide an elastic snapping groove of the bead 46 or the upper shank 36 in the distribution position. Likewise, to limit the plugging end-of-travel impacts, it is possible not to provide an elastic snapping groove for the bead 46 or the lower shank 34 in the plugging position of FIG. 3. The arrival in the plugging position with no impact makes it possible to still further decrease the risks of un-sticking of the liquid trapped on the walls of the retention volume 60, and in particular on the walls of the ribs 56.

Naturally, various alternatives may be considered. Some of the ribs may be omitted or their shape may be modified if the retention of the liquid by adhesion on the walls of the ribs is not essential in a given application, for example if the interfacial tension between the considered beverage and the walls of the ribs is not sufficient for a noticeable effect. In this case, the abutment may be formed by an annular shoulder of the bottom, or preferably by spacers—i.e., ribs with a small radial length—distributed on the circumference of the bottom. It is also possible to consider having the abutment be made by an annular portion not protruding from the bottom serving as a seat, on which ribs made on the annular connecting wall of the spout bear. Irrespective of the selected solution, it is necessary to account for the rotational freedom of the plug relative to the spout. It is also preferably necessary to distribute the contact between the stop and the counter-stop seat on the circumference of the device, to avoid misalignment of the plug relative to the spout. It is lastly preferably necessary to limit the quantity of material used. To meet all of these constraints, and in particular inasmuch as one of the surfaces of the abutment, on the spout side or plug side, must protrude toward the other part to form the retention volume, it is of interest to provide that the protruding portion is made up of individual elements distributed on the circumference of the device, and bearing on the other part against an annular seat obtained without adding material. The base and the plug are preferably both made from plastic obtained by injection molding.

The invention claimed is:

1. A push-pull stopper device to be secured to a container neck intended for a liquid, the stopper device comprising:

(a) a tubular spout defining a reference axis of the device and delimiting a passage opening; and (b) a plug that can be pulled relative to the tubular spout parallel to the reference axis from a plugging position to a distribution position and pushed relative to the tubular spout parallel to the reference axis from the distribution position to the plugging position, the plug further comprising:

an outer tubular shell enveloping the tubular spout and sliding on the tubular spout; and a bottom extending perpendicular to the reference axis, the bottom being provided with a sealing skirt, and several distribution holes, the sealing skirt cooperating with the tubular spout in the plugging position to plug the passage opening, and freeing the passage opening to form several passageways from the container toward the outside through the passage opening and the distribution holes when the plug goes from the plugging position to the distribution position;

wherein the bottom of the plug includes radial ribs positioned one between each two of the distribution holes, wherein the radial ribs form retention facets by adherence of the liquid located between the bottom of the plug and the tubular spout;

wherein the bottom has, in a space not occupied by the ribs and outside the distribution holes, a planar surface facing the spout and perpendicular to the ribs;

wherein the tubular spout includes an outer tubular guide wall on which the plug slides between the plugging and distribution positions, an inner tubular passage wall delimiting the passage orifice and which the sealing skirt penetrates to plug the passage opening by annular contact with the inner tubular passage wall, and an annular connecting wall extending radially from the outer tubular guide wall to the inner tubular passage wall; and wherein the ribs protrude downwardly from the planar surface of the bottom of the plug and extend toward the tubular spout to form a stop where the ribs contact the annular connecting wall of the tubular spout while preserving an annular retention volume between the bottom of the plug and the tubular spout when the plug is in the plugging position, the retention volume communicating with the outside by the distribution holes.

2. The stopper device according to claim 1, wherein the ribs have an axial dimension that is small near the geometric reference axis and increases moving radially away from the geometric reference axis.

3. The stopper device according to claim 1, wherein the outer tubular shell of the plug has at least one raised annular guide protruding radially toward the tubular spout and in sliding contact with a cylindrical guide surface of the tubular spout between the plugging and distribution positions.

4. The stopper device according to claim 1, wherein the tubular spout has at least one annular guide shank protruding radially toward the outer tubular shell of the plug and in sliding contact with a cylindrical guide surface of the outer tubular shell of the plug between the plugging and distribution positions.

5. The device according to claim 1, wherein the outer tubular shell of the plug has at least one raised annular guide protruding radially toward the tubular spout and in sliding contact with a cylindrical guide surface of the tubular spout between the plugging and distribution positions, the tubular spout has at least one annular guide shank protruding radially toward the outer tubular shell of the plug and in sliding contact with a cylindrical guide surface of the outer tubular shell of the plug between the plugging and distribution positions and the tubular spout has two annular guide shanks situated axially on either side of the annular guide shank of the outer tubular shell of the plug.

6. The stopper device according to claim 1, wherein the device does not snap into the distribution position.

7. The stopper device according to claim 1, wherein the plug is free to rotate relative to the spout about the reference axis both in the plugging position and the distribution position.

8. The stopper device according to claim 1, wherein the tubular spout is an integral part of a base having raised portions for fastening to the container neck.

9. The stopper device according to claim 1, wherein the outer tubular shell includes an end-of-travel distribution stop cooperating with the tubular spout to prevent the plug from separating from the tubular spout.

10. The stopper device according to claim 1, wherein each of the ribs intersects the adjacent distribution holes.

11. The stopper device according to claim 1, wherein the liquid is a beverage and the plug closing upon the spout deters undesired ejection of the beverage through the distribution holes toward a user of the device.

12. The stopper device according to claim 1, wherein the ribs have an axial dimension that is small near the reference axis and increases moving radially from the geometric reference axis with an offset-angled surface in an intermediate location between radial ends of the rib.

13. A push-pull plugging device to be secured to a container neck intended to contain a liquid, the plugging device comprising:

(a) a tubular spout defining a reference axis of the device, the spout including an outer tubular guide wall, an inner tubular passage wall delimiting a passage orifice, and an annular connecting wall between the outer tubular guide wall and the inner tubular passage wall; and (b) a plug that can be pulled relative to the outer tubular guide wall parallel to the reference axis from a plugging position to a distribution position and pushed relative to the outer tubular guide wall parallel to the reference axis from the distribution position to the plugging position, the plug comprising:

a tubular outer shell enveloping the tubular spout and sliding on the tubular spout; and a bottom extending perpendicular to the reference axis, the bottom being provided with a sealing skirt and several distribution holes distributed on the periphery of the skirt, the sealing skirt penetrating the inner tubular passage while in the plugging position to plug the passage orifice through annular contact with the inner tubular passage wall, and freeing the passage orifice to form several passageways from the container toward the outside through the passage orifice and the distribution holes when the plug is pulled from the plugging position to the distribution position, the bottom of the plug having radial ribs positioned one between each two of the distribution holes and wherein the ribs form retention walls by adhesion of the liquid located between the bottom of the plug and the annular connecting wall of the tubular spout, wherein the bottom has, in a space not occupied by the ribs and outside the distribution holes, a planar surface facing the spout and perpendicular to the ribs, and wherein the device does not snap into the plugging position; and wherein the ribs protrude downwardly from the planar surface of the bottom of the plug and extend toward the tubular spout to form a stop where the ribs contact the annular connecting wall of the tubular spout while preserving an annular retention volume between the bottom of the plug and the tubular spout when the plug is in the plugging position, the retention volume communicating with the outside by the distribution holes.

14. The plugging device according to claim 13, wherein the plug is free to rotate relative to the spout about the reference axis both in the plugging position and the distribution position.

15. The plugging device according to claim 13, wherein the several distribution holes include at least eight, circular-cylindrical distribution holes substantially surrounding the reference axis.

16. A push-pull plugging device to be secured to a container neck intended to contain a liquid, the plugging device comprising:

(a) a tubular spout defining a reference axis of the device and delimiting a passage orifice; and (b) a plug that can be pulled relative to the tubular spout parallel to the reference axis from a plugging position to a distribution position and pushed relative to the tubular spout parallel to the reference axis from the distribution position to the plugging position, the plug comprising:

a tubular outer shell enveloping the tubular spout and sliding on the tubular spout; and a bottom extending perpendicular to the reference axis, the bottom being provided with a sealing skirt and several distribution holes distributed on the periphery of the skirt, the sealing skirt cooperating with the tubular spout while in the plugging position to plug the passage orifice and freeing the passage orifice to form several passageways from the container toward the outside through the passage orifice and the distribution holes when the plug is pulled from the plugging opposition to the distribution position, the bottom of the plug having radial ribs positioned one between each two of the distribution holes and wherein the ribs form retention walls by adhesion of the liquid captured between the bottom of the plug and the tubular spout, wherein the bottom has, in a space not occupied by the ribs and outside the distribution holes, a planar surface facing the spout and perpendicular to the ribs, and wherein the tubular spout includes an outer tubular guide wall on which the plug slides between the plugging and distribution positions, an inner tubular passage wall delimiting the passage orifice and which the sealing skirt penetrates to plug the passage orifice by annular contact with the inner tubular passage wall, and an annular connecting wall extending radially from the outer tubular guide wall to the inner tubular passage wall; and wherein the ribs protrude downwardly from the planar surface of the bottom of the plug and extend toward the tubular spout to form a stop where the ribs contact the annular connecting wall of the tubular spout while preserving an annular retention volume between the bottom of the plug and the tubular spout when the plug is in the plugging position, the retention volume communicating with the outside by the distribution holes.

17. The plugging device according to claim 16, wherein the ribs have an axial dimension that is small near the reference axis and increases moving radially from the geometric reference axis with an offset-angled surface in an intermediate location between radial ends of the rib.

18. The plugging device according to claim 16, wherein each of the ribs intersects the adjacent distribution holes.

19. The plugging device according to claim 16, wherein the liquid is a beverage and the plug closing upon the spout deters undesired ejection of the beverage through the distribution holes toward a user of the device.

* * * * *